United States Patent [19]

Chow

[11] 4,315,187

[45] Feb. 9, 1982

[54] STROBOSCOPIC DISHCHARGE TUBE FOR PHOTOGRAPHY

[75] Inventor: Shing C. Chow, Kowloon Tong, Hong Kong

[73] Assignee: Nam Kwong Electric Co. Ltd., Tsuen Wan, Hong Kong

[21] Appl. No.: 93,942

[22] Filed: Nov. 13, 1979

[51] Int. Cl.[3] ..... H01J 61/80; H01J 19/70

[52] U.S. Cl. ..... 313/217; 313/178

[58] Field of Search ..... 313/217, 198, 178, 179, 313/210, 218

[56] References Cited

U.S. PATENT DOCUMENTS

| | | | |
|---|---|---|---|
| 2,162,505 | 6/1939 | James et al. | 313/217 |
| 2,468,221 | 4/1949 | Miller | 313/217 |
| 3,543,182 | 11/1970 | Witteman et al. | 313/217 |

*Primary Examiner*—Ernest F. Karlsen

*Attorney, Agent, or Firm*—Jordan and Hamburg

[57] ABSTRACT

A stroboscopic discharge tube for use in photography is provided which comprises a light-transmitting tube having its opposite ends closed, a cathode and an anode disposed within said tube, and plasma producing gas, said cathode comprising a first electric conducting stem extending through one end of the tube into the interior of the tube and a cathodic annular ring made of emissive material affixed to the stem at least by means of welding, said anode comprising a second electric conducting stem extending through the other end of the tube into the tube interior and an anodic annular ring made of impurity gas absorbing material secured to the second stem, the diameters of the cathodic and anodic rings being such that the outer peripheries of the rings are closely adjacent to the inner wall of the tube so as to define a confined discharging region between the two rings. The discharge tube of the invention provides stable light.

10 Claims, 2 Drawing Figures

STROBOSCOPIC DISHCHARGE TUBE FOR PHOTOGRAPHY

BACKGROUND OF THE INVENTION

1. Field of the Invention

This invention relates to a stroboscopic discharge tube, particularly to such discharge tube for use in photography.

2. Prior Art

It has been a common practice in the art of photography to use a stroboscopic discharge tube to make up for an insufficiency in the amount of light for exposure of the photographic film. The discharge tube is energized by electric current of 100 to 3,000 amperes, usually about 1,000 amperes to emanate light. The prior art stroboscopic discharge tube generally comprises a glass tube having its opposite ends closed, a cathode and an anode disposed in the tube, and a plasma producing gas sealed in the tube, said cathode comprising an electric conductive stem extending through one end of the tube into the tube interior and an annular ring formed of emissive material secured to the stem by firmly caulking the ring to the latter, said anode comprising a conductive stem alone extending through the other end of the tube into the interior, the diameter of said ring being such that the outer periphery of the ring is substantially spaced from the inner wall of the tube.

It has been found, however, that the conventional discharge tube has the serious drawbacks that the amount of the lighting level or luminous intensity is unstable, varying from discharge to discharge and that such discharge tubes have unevenness in quality, providing different luminous intensities from product to product. Thus, in some instances an adequate amount of light is not provided, and in some instances the lighting abruptly rises to an excessively high peak level and then rapidly diminishes, so that the photographic film in current use is not capable of capturing enough light to produce clear colors. Particularly, the self-developing, so-called "instant" film was unable to produce distinct colors with the prior art stroboscopic discharge tube. Moreover, the discharge tube had the disadvantages that when the discharge tube is adapted to a so-called automatic stroboscopic camera in which the amount of light emanating from the discharge tube is automatically controlled, a light receiving element which senses the amount of light from the discharge tube will give false instructions due to the instantly excessive high level of the light, thus resulting actually in deficiency of light amount.

OBJECTS AND SUMMARY OF THE INVENTION

It is an object of this invention to provide a photographic stroboscopic discharge tube which has overcome the aforesaid drawbacks to the prior art tube.

It is thus an object of the invention to provide a novel stroboscopic discharge tube in which the amount of glowing level is stable from discharge to discharge.

It is another object of the invention to provide a stroboscopic discharge tube having a constant level of quality in which the amount of lighting level does not vary from product to product.

It is still another object to provide a stroboscopic discharge tube in which the lighting declines gradually after reaching an optimal peak level and which provides a relatively long duration of flashing to thereby enable the production of distinct colors on the film.

It is a further object of the invention to provide a stroboscopic discharge tube which enables clear colors to be produced in the self-developing, so-called "instant" photography.

It is a still further object to provide a stroboscopic discharge tube having an extended useful lifetime.

To accomplish the foregoing objects, the present invention provides a stroboscopic discharge tube for use in photography, comprising a light-transmitting tube having its opposite ends closed, a cathode and an anode disposed within said tube, and plasma producing gas, said cathode comprising a first electric conducting stem extending through one end of the tube into the tube interior and a cathodic annular ring made of emissive material affixed to the stem at least by means of welding, said anode comprising a second electric conducting stem extending through the other end of the tube into the tube interior and an anodic annular ring made of impurity gas absorbing material secured to the second stem, the diameters of the cathodic and anodic rings being such that the outer peripheries of the rings are in closely spaced relation to the inner wall of the tube so as to define a confined discharging region between the two rings.

PREFERRED EMBODIMENTS OF THE INVENTION

Preferred embodiments of the invention will now be described with reference to the drawings.

Figure 1:
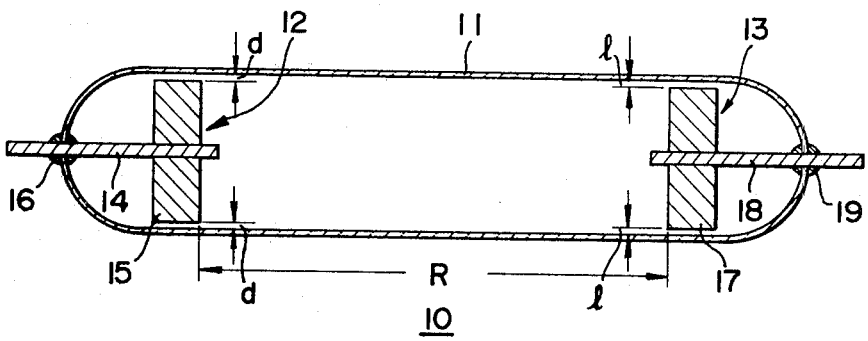
FIG. 1 is a schematic longitudinal section view of a stroboscopic discharge tube constructed according to the present invention.

Referring to FIG. 1, a photographic stroboscopic discharge tube according to the present invention is generally indicated at 10. A cathode 12 and an anode 13 are provided within a glass tube 11 having its opposite ends closed. The cathode 12 comprises a first conducting stem 14 extending through one end of the glass tube 11 into the tube interior and a cathodic annular ring 15 fixed to the stem 14. The conducting stem 14 may be formed of electric conducting material having a high melting point such as tungsten, molybdenum, or the like. The cathodic annular ring 15 may be formed by sintering emissive material composed of basic ingredients such as powders of titanium, tantalum, zirconium or a mixture thereof, and additives such as powders of barium, calcium, cesium, or oxides thereof, or a mixture thereof. Incidentally, by the term "annular ring" herein used is meant not only an exactly circular shape but also, for example an octagonal shape so far as the confined discharging region is defined as will be described in detail hereinafter.

An annular ring 15, as formed by compression molding and sintering emissive material, may be fitted over the stem 14. Alternatively, an unsintered annular ring 15, as formed by compression molding emissive material, may be fitted over the stem 14 and thereafter subjected to sintering process. The sintering process may be effected usually at a temperature of 1000° C. to 2500° C. in one minute to two hours.

Hitherto, the thus produced annular ring 15 has been secured to the stem merely by firmly caulking the ring to the stem. However, the caulking operation not only deforms the ring, resulting in degrading the commercial value of the product, but also causes unevenness in the glowing level from discharge to discharge as well as from product to product. According to the present invention, the annular ring 15 is affixed to the stem 14 at least by means of welding. More specifically, the ring 15 is joined to the stem 14 by welding accompanied by a light or no caulking operation, whereby any deformation of the annular ring 15 may be prevented and the resistance to flow of current from the stem 14 to the ring 15 may be minimized.

The welding may preferably be carried out by spot welding, butt welding, or laser welding. The spot or butt welding operation is accomplished preferably within one minute by connecting the stem 14 and ring 15 to electrodes of opposite polarities, employing a conventional welder having an output power in approximately ten joules. It should be noted that care should be taken in welding since an excessive welding operation would deteriorate and render brittle the emissive material of which the ring 15 is made, to thereby disable the ring 15 from fulfilling its designed function.

When the laser welding is effected, it is preferable to employ YAG laser (yttrium/aluminum/garnet laser) which is capable of welding a narrow localized joint area intensively and precisely. Typically, the welding may be carried out by irradiating an interface between the ring 15 and stem 14 with laser rays for within a few seconds with a laser welder having an output power of less than 20 joules. Since the laser welding is capable of welding at as narrow an area as in the range of several microns to several tens of microns, it is possible to minimize the deterioration of the emissive material due to the welding by precisely controlling the welding operation. Of course, it is possible to use "soft" caulking in combination with the laser welding.

A bead 16 of glass material which has good bonding properties to both the glass tube 11 and stem 14 is fused to the stem at a temperature of about 1,000° C. Then, the bead 16 is bonded to the glass tube 11 at a temperature of about 1,000° C. after a sintered ring 15 is secured to the stem 14 by welding accompanied by a light or no caulking operation.

When an unsintered compression sintered annular ring 15 is subjected to sintering process subsequently to inserting the ring over a stem 14, the stem may be broken in two sections whereupon a bead 16 is fused to one section of the stem while the ring 15 is inserted over the other section and sintered. Thereafter the two sections of the stem is, for example, butt welded together. This procedure is desirable because if an assembly of an annular ring 15 and an entire stem 14 having a bead 16 fused thereto is bodily subjected to sintering, the bead would be melted away during the sintering. On the other hand, if a bead 16 is fused to a stem 16 having an unsintered ring 15 inserted thereover, the ring would be oxidized in the atmospheric air and the emissive material would be hydrogenated and change in quality in the presence of hydrogen.

The anode 13 may be formed by either securing an anodic annular ring 17 to a second conducting stem 18 by means of caulking only or welding the ring to the stem in the same manner as with the cathode 12. The annular ring 17 is made of an impurity gas absorbing material which is capable of absorbing impurity gases such as $CO_2$, CO, $N_2$, $H_2O$ and $O_2$ that will be produced as an electric discharge takes place in the atmosphere of a plasma generating gas such as xenon gas contained in the glass tube 11. The impurity gas absorbing material of which the anodic ring is made may be similar to the sintered materials hereinabove mentioned as suitable to form the cathodic ring 15. The anode 13 may be fabricated in the same manner as those described in connection with the cathode 12. The stem 18 has fused thereto a bead 19, which is in turn bonded to the glass tube 11. The second stem 18 may be formed of the same material as that which the first stem 14 is made of.

According to the present invention, the diameters of the cathodic and anodic annular rings 15 and 17 are so selected that the outer peripheries of those rings are closely adjacent to the inner wall of the glass tube 11. In the prior art stroboscopic discharge tube, there is a substantial spacing between a cathodic annular ring and the wall of a glass tube, and the anode comprises a stem alone, so that xenon gas will escape from the discharge zone through the space between the cathodic ring and the tube wall instantaneously upon discharging, whereupon the glass pressure within the discharge zone drops with impurity gases remaining in the tube. Because of this, the conventional tube have the drawback that the peak level of lighting varies from discharge to discharge.

According to the present invention, radial gaps (d) and (l) between the cathodic ring 15 and the wall of the glass tube 11 and between the anodic ring 17 and the tube wall, respectively may be of 0.2 to 0.6 mm, preferably 0.2 to 0.4 mm. The anodic ring 17 according to the invention cooperates with the opposing cathodic ring 15 to define a confined discharge region R therebetween, whereby the pressure of xenon gas is prevented from dropping rapidly during the discharge. Moreover, impurity gases generated within the discharge region R are absorbed by the anodic ring 17 as well as by the cathodic ring 15, both rings being at an elevated temperature, before the gases escape away towards the ends of the glass tube 11 whereby the useful life of the tube is extended.

It should be noted that if there were no gaps (d) or (l), the glass tube could be destroyed due to an excessively high temperature and/or a high gas pressure.

As an example of the present invention, 95% by weight of powders of titanium, were mixed with 4% by weight of powders of barium oxide, 1% by weight of powders of calcium oxide and a trace of cesium oxide, respectively. The mixture was then compression molded to form a pair of annular rings having a diameter of 2.0 mm and a thickness of 2.0 mm. Those rings were sintered at 1500° C. for about an hour in an oven. A pair of tungsten stems 0.8 mm in diameter and 6.0 mm long were provided. A bead was fused to each of the stems at a temperature of 1000° C. The stems were each inserted into the associated sintered annular rings and welded thereto at an output of about 10 joules for about 1/1000 seconds, employing a spot welding machine manufactured by Toun Co., Ltd.. The thus obtained annular rings were disposed in a glass tube having an inner diameter of 2.4 mm to constitute a cathode and an anode and xenon gas at a pressure of 500 mm Hg was sealed in the tube to complete a discharge tube of the present invention.

As a comparative example of the prior art, a conventional discharge tube was fabricated in the same manner except that the anode having a diameter of 1.2 mm was comprised of a stem alone and that a cathodic sintered ring was fixed to the associated stem by means of caulking only to constitute a cathode.

Figure 2:
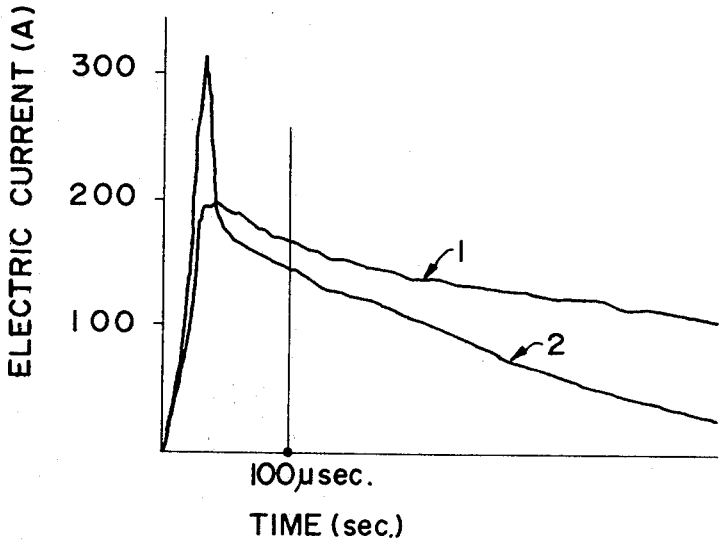
FIG. 2 is a graph showing flashing properties.

The flashing level characteristics of each discharge tube were determined by the use of a condenser having a voltage of 330 V and an electric capacity of about 800 μF. With the discharge tube of the present invention, the flashing level (indicated by electric current value) rose abruptly and then gradually declined as represented by a curve I in FIG. 2. In contrast, the comparative prior art discharge tube abruptly reached a higher flash peak, followed by a rapid drop as represented by a curve 2 in FIG. 2. The discharge tube of this invention exhibited the flashing properties substantially the same as those indicated by the curve 1 over 100 test discharges, whereas in the comparative discharge tube the flash peak varied from discharge to discharge.

While the present invention has been described with reference to a specific embodiment of the invention, various variations and modifications may be made without departing from the spirit of the invention. It is intended to include all such variations and modifications.

What is claimed is:

1. A stroboscopic discharge tube for use in photography, comprising a light-transmitting tube having its opposite ends closed, a cathode and an anode disposed within said tube, and plasma producing gas, said cathode comprising a first electric conducting stem extending through one end of the tube into the interior of the tube and a cathodic annular ring made of emissive material affixed to the stem at least by means of welding, said anode comprising a second electric conducting stem extending through the other end of the tube into the tube interior and an anodic annular ring made of impurity gas absorbing material secured to the second stem, the diameters of the cathodic and anodic rings being such that the outer peripheries of the rings are closely adjacent to the inner wall of the tube so as to define a confined discharging region between the two rings.

2. A stroboscopic discharge tube according to claim 1 wherein said cathodic annular ring is formed by compression molding and sintering emissive material, and inserted over said first stem.

3. A stroboscopic discharge tube according to claim 1 wherein said cathodic ring is compression molded of emissive material and inserted over said first stem, followed by sintering said cathodic ring.

4. A stroboscopic discharge tube according to claim 1 wherein said cathodic ring is joined to the first stem by welding accompanied by a light or no caulking operation.

5. A stroboscopic discharge tube according to claim 1 wherein said welding is effected by spot welding, butt welding or laser welding.

6. A stroboscopic discharge tube according to claim 3 wherein said first stem is divided in two sections, and a bead is fused to one of the sections while said cathodic ring is inserted over the other section and subjected to sintering process, and thereafter the two sections are joined together by welding.

7. A stroboscopic discharge tube according to claim 1 wherein the radial gaps between said cathodic ring and the inner wall of the tube and between said anodic ring and the tube wall are in the range of 0.2 to 0.6 mm.

8. In a stroboscopic discharge tube comprising a light transmitting tube having closed ends, wherein the cathode comprises a conductive stem extending through one end of the tube and having an annular ring of emissive material affixed to the stem within the tube, and an anode comprises a conductive stem extending through the opposite end of the tube; the improvement wherein the annular ring at said cathode is welded to the cathode stem, and the anode further comprises an annular ring of impurity gas absorbing material affixed to the anode stem, the outer peripheries of the annular rings of the anode and cathode each being spaced from 0.2 to 0.6 millimeters from the inner wall of said tube radially outwardly of the respective annular ring.

9. The stroboscopic discharge tube of claim 8 wherein the surfaces of the annular rings of the anode and cathode facing one another are substantially flat and parallel to one another, and the sides of the discharge tube are substantially straight.

10. The stroboscopic discharge tube of claim 9 wherein the annular rings of the anode and cathode are fitted over the respective stems, the facing ends of the respective stems being closer to one another than the annular rings positioned thereon.

* * * * *